US010023339B2

(12) United States Patent
Pipes et al.

(10) Patent No.: US 10,023,339 B2
(45) Date of Patent: Jul. 17, 2018

(54) FIVE-SIDED CIGARETTE CARTON PACKAGING

(71) Applicants: Jerry Wayne Pipes, Clemmons, NC (US); Mark Shane Hatcher, Pfafftown, NC (US); Wesley Steven Jones, Lexington, NC (US)

(72) Inventors: Jerry Wayne Pipes, Clemmons, NC (US); Mark Shane Hatcher, Pfafftown, NC (US); Wesley Steven Jones, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 214 days.

(21) Appl. No.: 14/032,538

(22) Filed: Sep. 20, 2013

(65) Prior Publication Data

US 2014/0020340 A1 Jan. 23, 2014

Related U.S. Application Data

(63) Continuation of application No. 13/016,463, filed on Jan. 28, 2011, now Pat. No. 8,549,823.

(60) Provisional application No. 61/300,968, filed on Feb. 3, 2010.

(51) Int. Cl.

| | |
|---|---|
| ***B65B 51/10*** | (2006.01) |
| ***B31B 50/26*** | (2017.01) |
| *B65B 19/02* | (2006.01) |
| *B65B 53/02* | (2006.01) |
| *B31B 100/00* | (2017.01) |

(52) U.S. Cl.

CPC ..... *B65B 51/10* (2013.01); *B31B 50/26* (2017.08); *B31B 2100/00* (2017.08); *B65B 19/02* (2013.01); *B65B 19/025* (2013.01); *B65B 53/02* (2013.01); *B65B 2220/16* (2013.01)

(58) Field of Classification Search

CPC ..... B65B 51/10; B65B 19/02; B65B 19/025; B65B 2220/16; B65B 53/02; B31B 50/26; B31B 2100/00

See application file for complete search history.

(56) References Cited

U.S. PATENT DOCUMENTS

| | | | | |
|---|---|---|---|---|
| 2,825,343 A | | 3/1958 | Richner | |
| 2,842,261 A | | 7/1958 | Lighter | |
| 3,071,244 A | | 1/1963 | Doran | |
| 3,113,673 A | | 12/1963 | Stein | |
| 3,493,106 A | * | 2/1970 | Galli | B65D 71/08 206/497 |
| 3,752,308 A | | 8/1973 | Begemann | |
| 3,804,235 A | | 4/1974 | Anderson | |
| D266,224 S | | 9/1982 | Bronander, Jr. | |

(Continued)

*Primary Examiner* — Christopher R Harmon
(74) *Attorney, Agent, or Firm* — Brinks Gilson & Lione

(57) ABSTRACT

Methods and machines are provided for forming a five-sided carton of packages of smoking articles. A piece of film material is applied to a plurality of packages of smoking articles such that five sides of the plurality of packages are at least partially covered by the film material, but the sixth side remains uncovered. The film material is applied such that the group of packages is sufficiently tightly bound so that none of the packages may slip free from the carton. The sixth side of the plurality of packages in the carton remains exposed so that tax stamps may be easily applied. The film of material may be applied so that a gap is formed relative to the sixth side.

10 Claims, 7 Drawing Sheets

(56) References Cited

U.S. PATENT DOCUMENTS

| | | | | |
|---|---|---|---|---|
| 4,586,312 | A | 5/1986 | Limousin | |
| 4,641,488 | A * | 2/1987 | Garr | B65B 53/02 53/176 |
| 4,666,749 | A * | 5/1987 | McCurry | B29C 51/16 206/408 |
| 4,738,359 | A * | 4/1988 | Phillips, Jr. | B65D 85/1072 206/256 |
| 4,852,734 | A | 8/1989 | Allen et al. | |
| 4,903,844 | A | 2/1990 | Oglesby | |
| 4,928,817 | A | 5/1990 | Focke | |
| 4,932,534 | A | 6/1990 | Focke et al. | |
| 5,139,140 | A | 8/1992 | Burrows et al. | |
| 5,147,037 | A * | 9/1992 | Evers | B65D 5/5495 206/256 |
| 5,158,178 | A | 10/1992 | Cobler | |
| 5,174,443 | A | 12/1992 | Chance et al. | |
| 5,193,674 | A | 3/1993 | Cobler et al. | |
| 5,299,406 | A * | 4/1994 | Laury | B65B 53/02 53/134.1 |
| 5,431,277 | A | 7/1995 | Focke | |
| 5,526,559 | A | 6/1996 | Fleenor et al. | |
| 5,766,280 | A * | 6/1998 | Hallqvist | B65B 41/18 53/399 |
| D427,369 | S | 6/2000 | Bowen et al. | |
| 6,234,943 | B1 | 5/2001 | Copin | |
| 6,491,161 | B1 | 12/2002 | Focke et al. | |
| 6,851,553 | B2 | 2/2005 | Venable et al. | |
| 7,100,764 | B2 | 9/2006 | Focke | |
| D532,702 | S | 11/2006 | Berman | |
| D537,363 | S | 2/2007 | Petrucci | |
| 7,234,593 | B2 | 6/2007 | Fath et al. | |
| D592,051 | S | 5/2009 | Casebasse | |
| D601,435 | S | 10/2009 | Fell et al. | |
| D613,182 | S | 4/2010 | Fell et al. | |
| D619,477 | S | 7/2010 | Frizell et al. | |
| 2002/0074258 | A1 | 6/2002 | McCown et al. | |
| 2010/0155292 | A1 * | 6/2010 | Fell | B65B 11/48 206/738 |

* cited by examiner

FILM AND PACK COLLATION

FILM FOLDED AROUND PACKS

FILM TUCKED

UPPER FLAP FOLDED

FOLDS COMPLETED

FIVE-SIDED CIGARETTE CARTON PACKAGING

CROSS-REFERENCE TO RELATED APPLICATIONS

This application is a continuation of U.S. application Ser. No. 13/016,463, filed Jan. 28, 2011, which claims priority to U.S. Provisional Application No. 61/300,968, filed Feb. 3, 2010, each of which is incorporated herein by reference in its entirety.

FIELD OF THE INVENTION

The present invention relates to products made or derived from tobacco, or that otherwise incorporate tobacco, and are intended for human consumption. In particular, the present invention relates to the packaging of smoking articles such as cigarettes into cartons, and in particular, to the packing of packages of cigarettes into cartons such that the individual packages can be readily tax stamped.

BACKGROUND

It is common practice to ship and store cigarette packages in cartons. Conventional or standard cigarette cartons ordinarily hold ten packages, each package containing about 20 cigarettes. The packages are usually arranged into two relatively superposed rows of 5 packages each. Such standard cartons are often made from paperboard blanks, which are folded to completely encase the cigarette packages and are provided with glued flaps. Examples of cartons for ten packages of cigarettes are provided in U.S. Pat. No. 3,752,308 to Begemann; U.S. Pat. No. 4,738,359 to Phillips, Jr., and U.S. Pat. No. 4,903,844 to Oglesby, each of which is incorporated herein by reference in its entirety.

It is also known to ship and store cigarette packages in cartons having openings or removable portions to enable easier dispensing of the packages contained within. Such cartons are often made from paperboard blanks folded to encase the cigarette packages. Examples of such cartons for ten packages of cigarettes are provided in U.S. Pat. No. 6,851,553 to Venable et al., which is incorporated herein by reference in its entirety.

Individual jurisdictions require the application of a tax stamp to each package of cigarettes sold in the respective jurisdiction. Typically, the distributor or jobber in the jurisdiction receives the cartons from the manufacturer, unseals the flap of carton, which is sealed with a fugitive adhesive, applies the tax stamp to each package of cigarettes, and then recloses and reseals the carton. In order to minimize the time, labor and expense associated with tax stamping of the packages within the carton, various automated tax marking or stamping machines have been developed. Such tax marking machines automatically print or otherwise affix tax stamps to packages within the carton. Tax stamping machines which are most commonly employed by distributors and jobbers include the VL-10, SSM, SSMP, Tax Stamp Applying Machines which are available from Meyercord, Carol Stream, Ill.; and the CSU 120 or DTS Cigarette Tax Stamping Machines which are available from R.E.D. Stamp, Wyoming, Mich. Accordingly, the dimensions and construction of the standard cigarette carton have been established by the tax stamping machinery customarily employed by the distributors, wholesalers and jobbers who tax mark the cigarette packages prior to retail sale.

A manufacturer desiring to provide cigarette packages in non-standard sized or shaped cartons is forced to pay to have the individual packages hand tax stamped. Alternatively, the manufacturer can package cigarette packages in standard sized or shaped cartons for tax stamping and handling, and then manually load the tax stamped packages into non-standard sized or shaped cartons. However, a manual method for providing non-standard sized or shaped cartons of packages cigarettes is time consuming, laborious, and expensive.

As disclosed in *Modern Packaging*, (1947), half carton packs have been provided using a three sided paperboard collar and cellophane wrap such that the bottom of the cigarette packages are exposed for tax stamping. As disclosed in the previously incorporated U.S. Pat. No. 4,738,359 to Philips, Jr., cigarette packages can be contained in half cartons which can be tax stamped while in a master carton and later removed from the master carton for sale. Additional methods for packaging cigarettes into smaller packages can be found in U.S. Pat. No. 5,158,178 to Cobler; U.S. Pat. No. 5,193,674 to Cobler et al., each of which is incorporated herein by reference in its entirety. A heat shrinkable carton of cigarette packages with a frangible access panel that is removed for tax stamping can be found in U.S. Pat. No. 4,586,312, which is incorporated herein by reference in its entirety. A paperboard carton of cigarette packages having a major portion of the package ends exposed for tax stamping can be found in U.S. Pat. No. 3,071,244, which is incorporated herein by reference in its entirety.

BRIEF SUMMARY

Systems and methods for manufacturing five-sided cartons for packages of smoking articles are presented. The invention may include any of the following aspects in various combinations and may also include any other aspect described below in the written description or in the attached drawings.

Methods are presented for forming a carton for a group of packages of smoking articles. In one example, a plurality of packages can be assembled into a desired configuration to form a group of packages. The desired configuration may be substantially box-shaped. A piece of film material of a predetermined sized can be supplied. The film material can be folded over the group of packages such that film material forms a U-shape. The U-shaped configuration can cover a top surface of the group of packages, can form front and back portions to cover at least a portion of opposing front and back surfaces of the group of packages, can form first extended portions of the film material to extend beyond side edges of the top surface, and can form second and third extended portions of the film material to extend beyond side edges of the respective front and back surfaces of the group of packages. The first extended portions of film material can be tucked to be flush with opposing left and right sides of the group of packages. The second extended portions of film material can be folded to be flush with the left and right sides of the group of packages. The third extended portions of film material can be folded to be flush with the left and right sides of the group of packages, such that the tucked and folded portions of film material on the left and right sides of the group of packages form left and right overlapping portions. A first heat can be applied to the left and right overlapping portions for a first period of time to seal the film material forming the overlapping portions together. A second heat can be applied to at least a portion of the film material surrounding the group of packages for a second period of time to heat shrink the film material to a confining fit about the group of packages, whereby a bottom surface of the group of packages remains uncovered by the film material In another example, a group of packages of smoking articles can be assembled. Each package of smoking articles can be individually wrapped with a package film material. The group of packages can have a substantially orthogonal parallelepiped shape with top, bottom, front, back, left and right sides. A carton film can be applied to the group of packages so that the carton film material covers the top of each of the packages. The carton film material may have sealing properties incompatible with sealing properties of the package film material. The carton film material can be folded about the group of packages such that the carton film material covers all of the top side of the group of packages, at least a portion of the front, back, right and left sides of the group of packages while leaving the bottom side of the group of packages uncovered. Portions of the carton film material can overlap one another on each of the right and left sides of the group of packages. The overlapping portions of carton film material can be head sealed together. At least portions of the carton film material can be heat shrinked to form a confining fit about the group of packages.

In another embodiment, a machine for forming a five-sided cigarette carton is presented. The machine can include the following components. A pusher can be configured to advance a group of packages of smoking articles that has a boxed shape from an input position into a pre-determined size of a sheet of film. A first folding mechanism defining an opening for receiving the group of packages can be configured to fold the sheet of film about the group of packages. The sheet of film may assume a substantially U-shape to cover at least partially a top side of the group of packages and at least a portion of front and back sides of the group of packages. A film tucking mechanism may be positioned downstream from the first folding mechanism, and can be configured to tuck first extended portions of the sheet of film flush with right and left sides of the group of packages. Each of the first extended portions before tucking can be substantially coplanar with the top side of the group of packages and can extend beyond respective right and left ends of the top side of the group of packages. A second folding mechanism can be positioned downstream from the film tucking mechanism. The second folding mechanism can be configured to fold second extended portions of the sheet of the film flush with the right and left sides of the group of packages. Each of the second extended portions before folding can be substantially coplanar with either the front or back side of the group of packages and can extend beyond right and left ends of the front or back sides of the group of packages. A third folding mechanism can be positioned downstream from the film tucking mechanism or the second folding mechanism. The third folding mechanism can be configured to fold third extended portions of the sheet of the film flush with the right and left sides of the group of packages. Each of third extended portions before folding can be substantially coplanar with the other of the front or back side of the group of packages and can extend beyond the right and left ends of the front or back sides of the group of packages. The first, second, and third extended portions can form overlapping portions of the sheet of film on each of the right and left sides of the group of packages. A heat sealing mechanism can be positioned downstream from the third folding mechanism. The heat sealing mechanism can be configured to heat the overlapping portions of the sheet of film thereby sealing the overlapping portions together. A heat generating device can be positioned downstream of the heat sealing mechanism. The heat generating device can be configured to heat selected portions of the sheet of film thereby heat shrinking the film about the group of packages.

BRIEF DESCRIPTION OF THE DRAWINGS

The invention may be more fully understood by reading the following Disclosure and Description of the Drawings in conjunction with the drawings.

DISCLOSURE AND DESCRIPTION OF THE DRAWINGS

Figure 1:
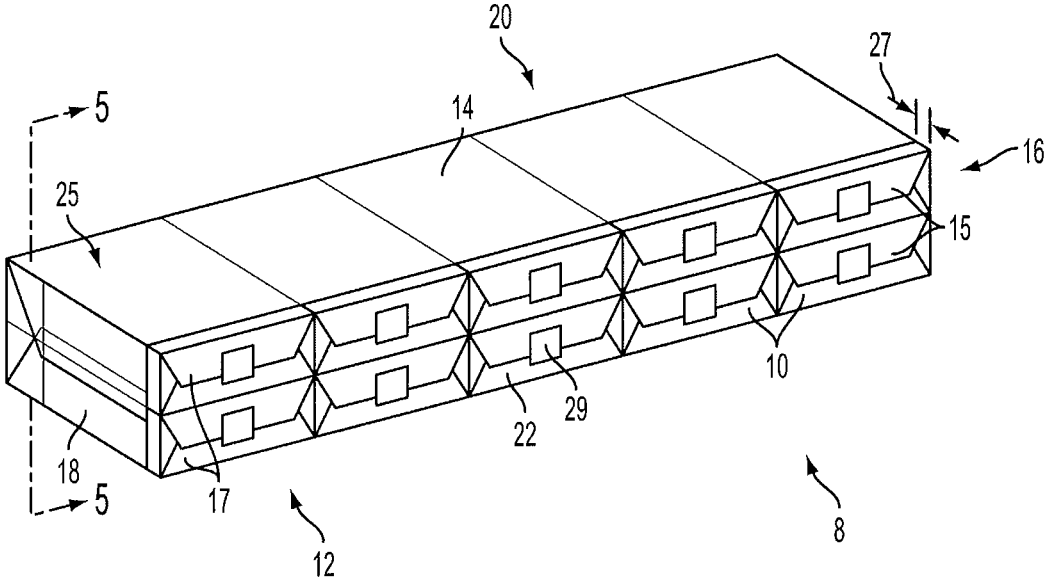
FIG. 1 shows an embodiment of a group of packages of smoking articles that has been formed into a five-sided carton.

FIG. 1 depicts a carton 8 of ten packages 10 of smoking articles, such as cigarettes, in a first arrangement such as a box-shaped arrangement. As known to those skilled in the art, each package 10 of smoking articles has a top, bottom, right, left, front, and back side. The first arrangement of packages 10 of smoking articles can be situated side-by-side into two rows of five packages (2×5 configuration), with a first row stacked directly against a second row. In this manner, the back sides of the first row of packages 10 can form a general back side of a box for a corresponding back side 12 of carton 8 to be applied against. Further, the front sides of the second row of packages 10 can form a general front side of a box for a corresponding front side 14 of carton 8, the right sides of the rightmost packages 15 can form a general right side of a box for a corresponding right side 16 of carton 8, and the left sides of the leftmost packages 17 can form a general left side of a box for a corresponding left side 18 of carton 8 to be applied against. The top sides of the first and second rows of packages 10 can form a general top side of a box for the corresponding top side 20 of carton 8 to be applied against, and the bottom sides of the first and second rows of packages 10 can form a general bottom side 22 of carton 8. To form the carton 8, the packages 10 in the first arrangement can be overwrapped with a sheet of material 25. The sheet material 25 can be applied in a manner to form the top side 20, at least partially the back and front sides 12, 14, and at least partially the right and left sides 16, 18 of carton 8. The sheet material 25 may cover between about 50% to about 100% of the front, back, right, and left sides of the group of packages. However, the bottom side 22 can be left at least partially exposed, if not completely uncovered by the sheet material 25.

The sheet material 25 in forming the carton 8 can be applied in a manner to form the top side 20 of carton 8 with a continuous portion of the sheet material 25 without any seams for covering the top sides of the packages (not shown). The sheet material 25 can be tucked and folded over the first and second rows of packages 10 to form the front side 14 and the back side 12 of carton 8. The sheet material 25 can be further tucked and folded over the rightmost packages 15 and the leftmost packages 17 to form the right side 16 and the left side 18 of carton 8 containing the group of packages 10. The right and left sides 16, 18 of carton 8 may include overlapping folded portions of the sheet material 25, which are joined to one another to form a snug carton assembly. In one example, the sheet material 25 after being tucked and folded covers at least about 50% of the respective surface length, and more preferably at least about three-quarters of the respective surface length, thereby forming a gap 27 from the edges defining the bottom side 22. The provision of the gap 27 can avoid portions of sheet material 25 from extending beyond the bottom side 22 to not affect subsequent steps of labeling or stamping. The measured gap 27 should be less than half the height, or less than one-fourth the height, of the cigarette carton, but preferably is in the range of about 1% to about 20%, or about 1 mm to about 15 mm, more preferably about 2% to about 7%, or about 2 mm to about 5 mm, and even more preferably about 4% to about 5%, or about 3.2 mm (0.125 inches). Preferably, the size of the gap 27 is uniform from the bottom side, although the size of the gap may vary along at least one of the front, back, left, and right sides.

Preferably, the carton 8 is in a five-sided arrangement to permit the bottom sides of each of the packages 10 to remain uncovered so that subsequent access to this region for other product processes or purposes, such as tax stamping, can be achieved without necessarily having to remove any of the packages 10 from the carton 8 formed by the sheet material 25. For instance, tax stamps 29 (shown as dashed boxes along the bottom side of each package) may be readily applied to individual packages without having to open or break carton assemblies prior to tax stamping, and then reseal or reform carton assemblies after tax stamping. Thus, automatic tax stamping machines of the types known to those skilled in the art may be used with the five-sided cartons disclosed herein.

Further, while the sheet material 25 can comprises of various materials, the sheet material 25 is preferably a plastic carton film material 25, and more preferably a heat shrinkable plastic film. Thus, further discussion will focus on the use of such plastic carton film materials, which will now be referenced as numeral 25. A plastic film may be advantageous because plastic films are less costly than the known paperboard materials. Further, plastic films are lighter in weight than paperboard materials, and the amount of plastic film required may be reduced because only five of the six sides of the group of packages are covered.

While the carton 8 of packages 10 has been described and shown in a two-by-five configuration, those skilled in the art can appreciate that other package arrangements and orientations may be used. For example, in some embodiments, the carton assembly may be formed such that the packages are arranged front-to-back in a single row of ten (1×10 configuration). Alternatively, more or fewer than ten packages may be included in the group. Variations in the number of packages and/or the orientation of packages are within the scope of this disclosure.

Figure 2:
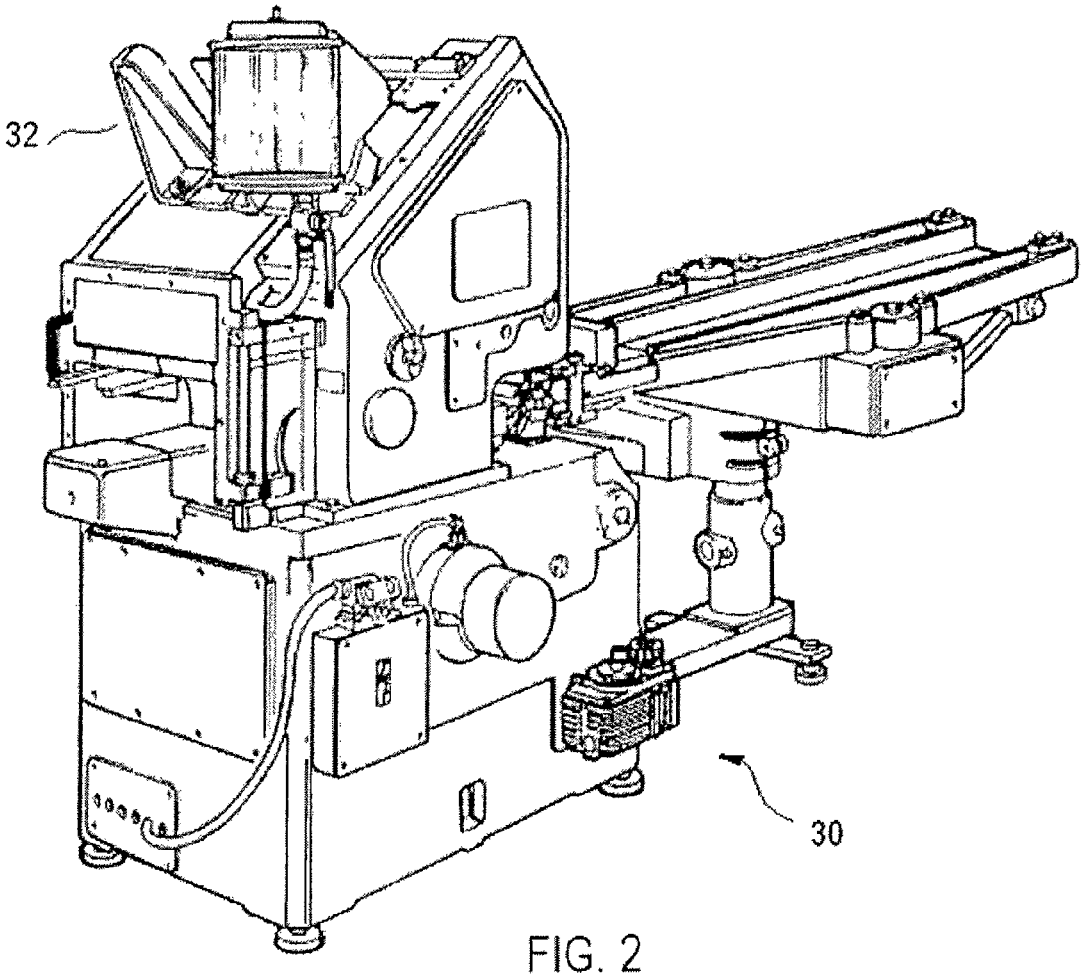
FIG. 2 shows a perspective view of a cartoning machine that may be modified to construct five-sided cartons.

Various packaging machinery can be used to apply the carton film material 25 to a group of packages 10 in order to form the carton 8. The machinery may include commercially available cigarette carton packaging machinery, which can be modified and repurposed to manufacture the carton 8 illustrated in FIG. 1. For instance, FIG. 2 depicts one embodiment of a carton packaging machine such as a cartoner 30, which is the model CT cartoning machine for paperboard cartoning, commercially available from G.D. S.p.A. of Bologna, Italy, which can be repurposed for film cartoning. While the CT cartoning machine is a commonly used cartoner, other cartoning machines from G.D. or other manufacturers may also be used and repurposed in a manner described herein.

To produce carton assemblies from a carton film material 25, cartoner 30 may include several modifications to the CT cartoning machine. For instance, cartoning machines typically include magazines 32 that are configured to hold paperboard carton blanks. For the plastic film cartons, magazines 32 may be removed and replaced with film feed systems. The film feed system may include a film reel assembly as well as a film reel adjustment screw, which allow for various sized plastic films to be used depending on the number and orientation of the packages to be cartoned. The film feed system may also include a cutting mechanism, which cuts the plastic film from a continuous roll of the film reel assembly to the desired size. Generally, the roll of plastic film is sized such that it is wider than the width of a row of packages (from the left to right side) in the group. That is, the roll is sufficiently wide so that a severed piece of carton film material 25 will extend far enough beyond both the rightmost and leftmost packages 15, 17 to allow for an overlapping portion of carton film material 25 to be formed at the right and left sides 16, 18 by the folding and tucking processes described herein.

Cartoner 30 may include another modification such as the replacement of the roller mechanisms used to transport the paperboard blanks from the magazine 32 to a pre-folding box with other mechanisms for transporting the film material. In one embodiment, vacuum belts may be used to transfer the severed pieces of carton film material 25 to the pre-folding box. While CT cartoning machines generally include the roller mechanisms, some newer CT cartoning machines may have vacuum belts instead of roller mechanisms. In these instances, the vacuum belts may be modified to transport plastic carton film material instead of paperboard blanks, as can be appreciated by those skilled in the art. In addition, the cartoner 30 may include another modification such as removing the paperboard carton gluing components, as well as the paperboard carton top flap folders. Moreover, the paperboard carton tuckers and folders may be replaced with plastic film tuckers and folders suitable for use with the plastic film materials. While the plastic film folders may be of any known variety in the art, fixed folders such as helical folders may be advantageous because they do not require any moving parts. Cartoner 30 may also include heat sealing mechanisms and heat shrinking mechanisms to seal and shrink the plastic film around the group of packages. In some embodiments, the heat shrinking mechanisms may consist of top and bottom heat plates. These heat plates may be added as an additional step, and may be positioned immediately outside of the heat sealing mechanisms (which may be positioned in the region previously used for applying adhesives).

Figure 3:
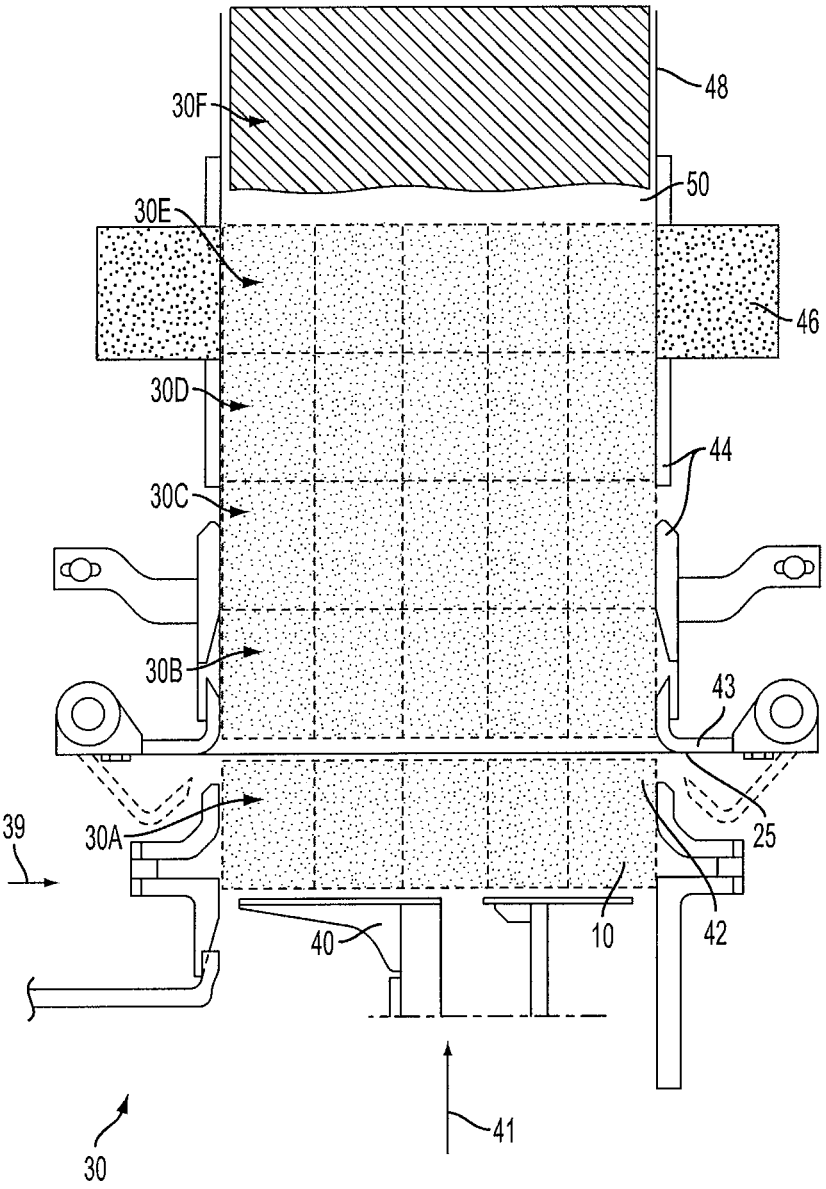
FIG. 3 shows a schematic view of the groups of packages of smoking articles within a modified cartoning machine as five-sided cartons are manufactured.

A process for cartoning a group of packages 10 using the cartoner 30, such as the modified CT cartoning machine described above, with carton film material 25 will now be described with reference to FIG. 3, which is not to scale, and FIGS. 4A-4E. When in operation, the cartoner 30 may contain simultaneously several groups of packages 10 at various stages of the cartoning process. Initially, individual packages 10 of smoking articles which may have its own film overwrapping are situated into the desired arrangement to form a group and can be fed into a first station 30A of the cartoner 30 through an opening on the left side of the machine in a direction represented by arrow 39. Once arranged into the desired arrangement (e.g., 2×5 configuration), the group of packages 10 of smoking articles can be pushed farther into the cartoner 30 by pushers 40 to a second station 30B in a direction represented by arrow 41.

The pushers 40 can advance and then press the group of packages 10 at the first station 30A against a pre-cut carton film material 25 (FIG. 4A), which is inserted orthogonal to the direction 41 of flow in the area 42. The carton film material 25 can be oriented such that a middle of the carton film material 25 is initially contacted by the top sides of the packages 10. As shown, the carton film material 25 is oriented orthogonal to the general moving direction 41 of the group of packages. For instance, the carton film material can be vertically oriented with respect to the horizontally moving group of packages. Photo sensors can be positioned in the cartoner 30 to verify that the carton film material 25 is properly positioned prior to the group of packages being pushed into the carton film.

When the group of packages 10 is pressed against the carton film material 25, the carton film material 25 can be folded, preferably to form a U-shaped configuration (FIG. 4B), on the way toward the second station 30B. Although the carton film material is shown positioned in close proximity to the second station 30B, the carton film material can be positioned along any portion of the first station 30A such that the first fold into the U-shape occurs at the first station 30A. Film folders such a fixed mandrels can be arranged on the top and bottom in a manner to cause the carton film material to assume the U-shape around the group of packages. In this configuration, the carton film material is oriented to cover the top sides of the packages, and at least portions of the back sides of the first row of packages and front sides of the second row of packages. Once the pushers 40 have advanced the group of packages 10 somewhat farther than one package height (measured from top to bottom), the pushers 40 can be withdrawn and the next group of packages can inserted into the first station 30A of the cartoner 30 from the direction 39. With advancement of each subsequent group of packages to the first station 30A, as described above, the groups of packages already in the cartoner 30 can be advanced to the next station for a subsequent step in the cartoning process.

Figure 4A:
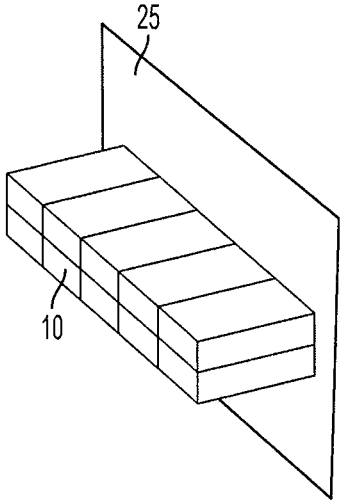
FIGS. 4A-4E show various steps of manufacturing a five-sided carton.
Figure 4B:
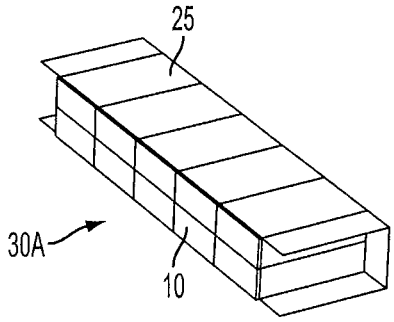
Figure 4C:
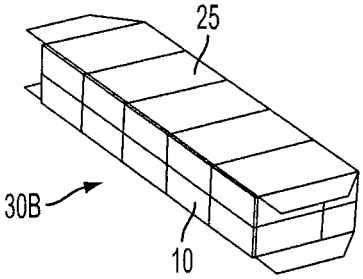
Figure 4D:
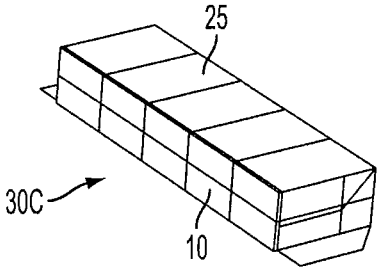
Figure 4E:
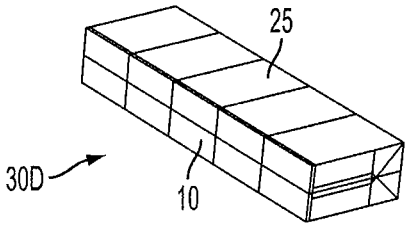

As a group of packages 10 is advanced along the second station 30B, film tuckers 43 can tuck portions of the carton film material 25, which are in the plane of the top surfaces of the packages but extend beyond the right and left sides of the group, down flush with the sides of the rightmost and leftmost packages (FIG. 4C). As the group of packages 10 is advanced to the third and fourth stations 30C, 30D, first and second folding mechanism such as upper and lower helical folders 44 fold portions of the carton film material 25, which are in the plane of the front surfaces of the second row of packages and bottom surfaces of the first row of packages, down flush with the sides of the rightmost and leftmost packages (FIGS. 4D-4E). Once the group of packages 10 has passed through the fourth station 30D, the carton film material 25 has been folded and tucked such that there are overlapping regions along the sides of the rightmost and leftmost packages.

With advancement of the group of packages 10 to the fifth station 30E, the side overlapping regions of the carton film material that form the right and left sides of the carton 8 can be exposed to a heat sealing mechanism such as impulse heaters or film sealers 46. The heat seal temperature and time can vary depending on the carton film material. In one example, the heat output of the heat sealing mechanism 46 can be in the range of about 140 degrees C. to about 160 degrees C. for less than a second. For example, the heat sealing mechanism can be impulse heaters that includes a bar with a coiled wire capable of short bursts of heat. The heat sealing mechanism 46 can apply heat to cause the overlapping regions along the sides of the rightmost and leftmost packages of the carton film material 25 to bond together. The heat sealing mechanism 46 can apply heat to cause the overlapping regions of the carton film material to bond together, but preferably not to the overwrapping of the individual packages.

Next, the group of packages 10 is advanced to the sixth station 30F, where a heat generating device 48 such as top and bottom heat plates can heat shrink the carton film material 25 to ensure a confining fit around five sides of the group of packages 10, thereby preventing any of the packages from slipping out of the container assembly. The heat shrink temperature and time can vary depending on the carton film material. In one example, the temperature of the heat generating device 48 can be in the range of about 110 degrees C. to about 120 degrees C. Preferably, the cartons move across heat plates and are in thermal communication with the heat plates for about one to two seconds, preferably about 1.5 seconds. Spacing 50 between the fifth and sixth stations 30E and 30F may be provided to allow for cooling of the overlapping regions before entering into the sixth station 30F in order to allow secure bonding of the side heat seals. A cooling mechanism, for example, air-cooled or water-cooled side plates, (not shown) can be substituted for spacing 50 to enhance cooling of the side heat seals in the overlapping side regions.

Figure 6:
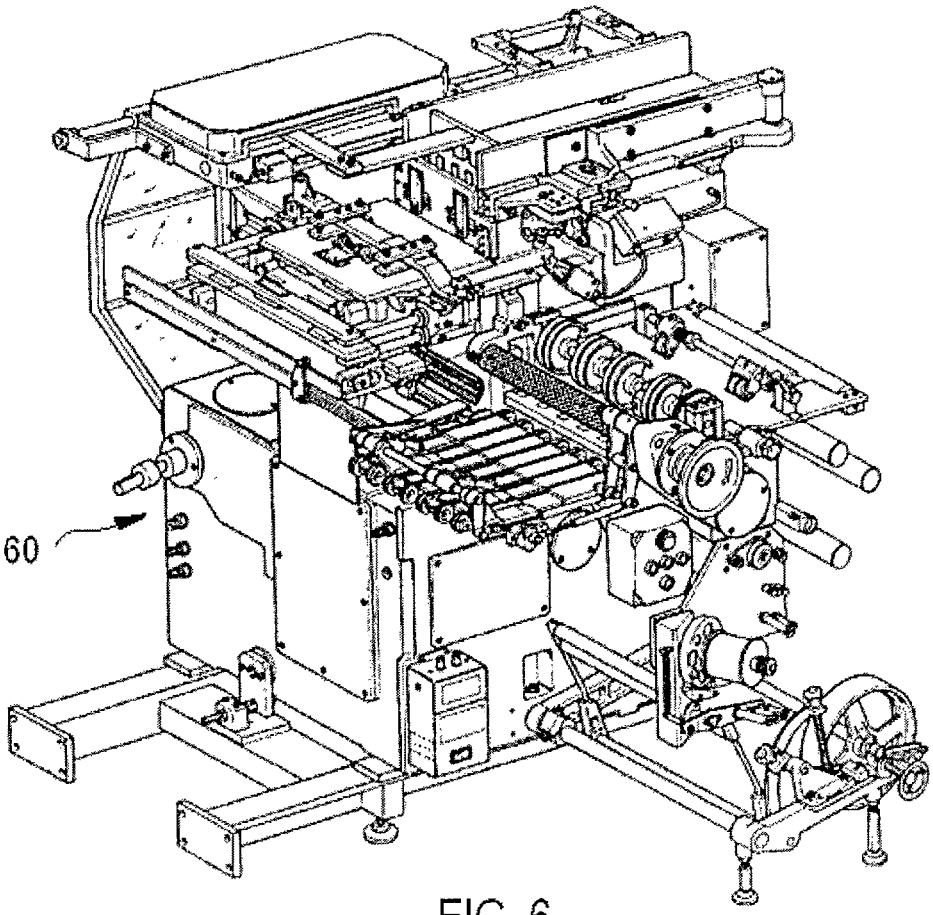
FIG. 6 shows an overwrapping machine that may be modified to construct five-sided cartons.

FIG. 6 depicts another commercially available cigarette carton packaging machinery, which can be modified and repurposed to manufacture the carton 8 illustrated in FIG. 1. For instance, FIG. 6 depicts an overwrapping machine 60, which is a model CV carton overwrapping machine, which is also available from G.D. S.p.A, which can be repurposed for film cartoning. While the CV carton overwrapping machine is a commonly used overwrapper, other carton overwrapping machines from G.D. or other manufacturers may also be used and repurposed such a described herein.

Figure 7:
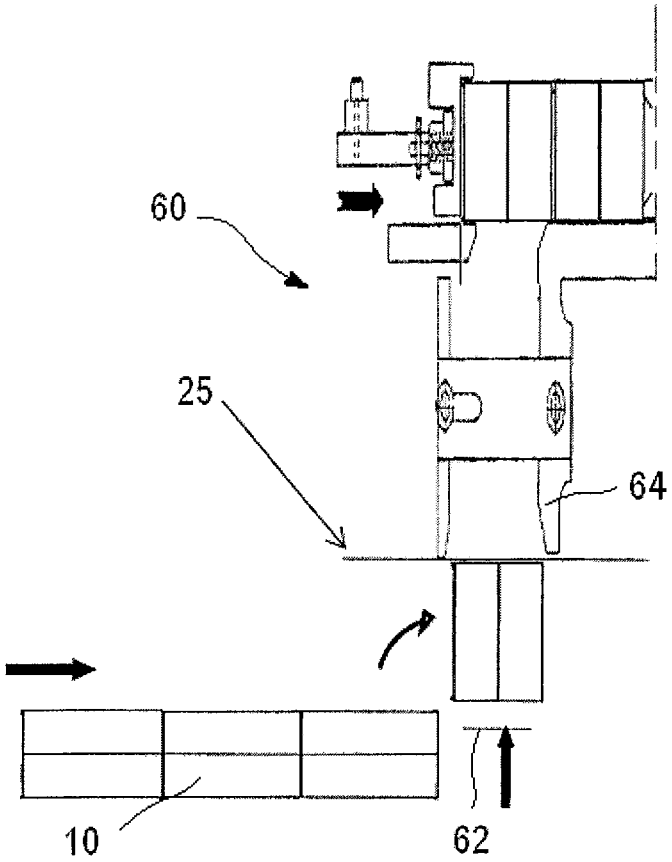
FIG. 7 shows a side-view of groups of packages of smoking articles being loaded into a modified carton overwrapping machine as they are formed into five-sided cartons.

A process for cartoning a group of packages 10 using the overwrapping machine 60, such as the modified CV carton overwrapping machine described above, with carton film material 25 will now be described with reference to FIG. 7, which is not to scale. As illustrated, a group of packages 10 is fed to the overwrapping machine 60 with the packages oriented with either the front surfaces or back surfaces facing up. The overwrapping machine 60 can include one modification by adding a mechanism, such as a star wheel, that reorients or rotates the group of packages 20 ninety degrees such that the group is placed on the elevator 62 with the top surfaces of the packages 10 facing up.

A pre-cut carton film material 25 can be positioned above the elevator 62 so that as the elevator 62 raises the group of packages 10, the film is pressed against the top surfaces of the packages. The carton film material may be positioned on the overwrapping machine 60 utilizing the film assembly from the overwrapping machine 60. The photo sensors can be present in the overwrapping machine 60, and may be adjusted to verify that the carton film material 25 is properly positioned prior to packages being elevated into the film. Alternatively, the film assembly may be modified for the different orientation of packages and for film sized to cover only five sides of the group of packages.

During the first elevation stroke, the carton film material 25 is pushed over the group of packages 10 into a U-shaped configuration (as described above) by the folders 64. During a subsequent elevation stroke, the portions of the carton film material 25, which are coplanar with the tops of the packages are tucked flush with the right and left sides of the group of packages 10 by tuckers (not shown). Thereafter, in additional elevation steps, the portions of the carton film material 25, which are coplanar with the front surfaces of the packages in the second row and back surfaces of the packages in the first row and extending beyond the right and left sides of the group of packages, are folded flush with the right and left sides of the group. Subsequently, heat sealers (not shown) can bond overlapping portions of the carton film material 25 on the right and left sides of the group of packages. Later, the carton film material wrapped group of packages passes on to a heat shrink mechanism, which may consist of a pair of opposing heat plates. The group of packages may be positioned within the pair of heat plates, with the front surfaces of the front row of packages and back surfaces of packages in the back row of packages roughly parallel with the adjacent heat plates. The heat plates can heat shrink the carton film material to form a confining fit around the five sides of the group of packages 10 (as explained above). Those of skill in the art will understand that the heat sealers of the sealing stage may already be present on the machine 60, and can be repurposed for such outcome. When present, the heat sealers may have to be reoriented to account for the rotated orientation of the group of packages.

Regardless of how the carton film material 25 is applied to the packages 10 to form the carton 8, those skilled in the art will understand that the carton film material 25 should be applied such that it is sufficiently tight around the group of packages to prevent any packages from slipping free. That is, the carton film material should have sufficient tautness that the carton film material carton can be turned upside down and none of the packages should slip. However, those skilled in the art will also understand that the carton film material should not be so taut that any of the individual packages are crushed or damaged. While the examples provided herein employ heat-shrinking to provide a confining fit, other manners of confining the packages, such as glue or banding, may be contemplated.

A variety of different carton film materials 25 may be used to form the container assemblies described herein. For example, in some embodiments, the carton film material may consist of a transparent or opaque plastic material. Exemplary carton film materials include oriented polypropylene (O.P.P.) and acrylic coated O.P.P. The carton film materials may be biaxially oriented polypropylene (B.O.P.P.), which is capable of shrinking in two orientations (roughly perpendicular to one another). Exemplary films include ZWA-S, ZXC25 and ZXA-25 polypropylene BOPP films available from Treofan Germany GmbH & Co. (Raunheim, Germany). However, those skilled in the art will understand that many different plastic materials, such as polyethylene, may be used for the carton film material. Alternatively, green/sustainable films may be used. For example, carton film materials derived from plant sources such as corn may be used. Additionally, biodegradable carton film materials may be used. Exemplary green film materials include polyhydroxyamide film (P.H.A.) and polylactic acid film (P.L.A.). Two exemplary green film materials are NATUREFLEX NE and NATUREFLEX NVS films available from Innovia Films Ltd. (Wigton, United Kingdom). Preferably, the carton film materials have a thickness of at least about 20 microns, and more preferably about 25 microns.

Figure 5:
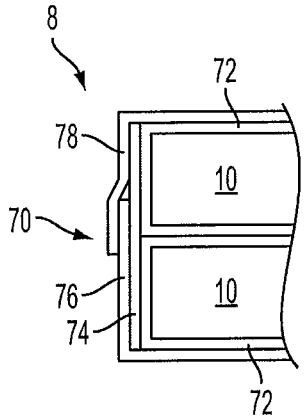
FIG. 5 is a partial cross-sectional view of an end of a carton taken along line 5-5 in FIG. 1, depicting overlapping region of the five-sided carton.

Whatever carton film material is selected, it should be such that the carton film material may seal to itself, such as having heat-sealable surfaces, and also heat shrink but not bond with the overwrapping package film materials that wrap each individual package of smoking articles. For example, FIG. 5 depicts a cross-sectional view of an end of the carton 8 of packages 10 in FIG. 1 with the carton film material forming the overlapping portions 70 and the package film material 72 surrounding the package film. The film thicknesses shown are exaggerated. As shown, the overlapping portion 70 can include a portion 74 extended from the top side, a portion 76 extended from the front side, and a portion 78 extended from the back side. Portions 74, 76, 78 of the carton film material can seal to one another, but preferably does not seal to the package film material 72 so that the packages can be removed without any interference from the carton film material. In order to properly seal to itself, the carton film material should bond to itself at a sealing temperature that is below the melting temperature of the carton film material. The film material may have a heat seal temperature between about 90 and 140 degrees C., with a melting temperature substantially higher. The sealing temperature for the carton film may be similar to the sealing temperature for the overwrap package film material on the individual packages. In such cases, the carton film material and the package film material should have incompatible bonding characteristics. That is, the two films should not adhere to one another when the carton film material forming the overlapping regions is sealed. While the films may have similar sealing temperatures, this is not necessary, and those skilled in the art will understand that carton film material with other sealing properties may be used. In another example, the carton film material can be configured such that the outer layer portion of the film is bondable (i.e., heat sealable) and an inner layer portion of the film is non-bondable (i.e., not heat sealable).

The temperatures at which the carton film materials are heat sealable and heat shrinkable will depend on the material properties of selected film material. Some carton film materials may be heat sealable and shrinkable at roughly 100 degrees C. However, those skilled in the art will understand that carton film materials may be heat sealable and shrinkable at any temperature so long as the temperature is not so high as to damage the overwrapping package film material on the individual packages of smoking articles inside the carton.

Carton film materials suitable for use as five-sided cartons may be heat shrinkable. Some suitable carton film materials have a heat shrink rating of between about 7 to 25 percent for at least one or both of the machine and transverse directions of the film under conventional heat shrink benchmark conditions. Other carton film materials may have a heat shrink rating of between about 10 to 15 percent for at least one or both of the machine and transverse directions of the film under conventional heat shrink benchmark conditions. In use, the preferred carton film materials used for the five-sided carton may shrink less than the maximum extent possible, and even less than the benchmark heat shrink ratings. For example, under the conditions applied in the process described herein, the carton film material may have total heat shrinkage of about 1 to 3 percent. Those skilled in the art will understand that the amount of heat shrinkage desired will depend on the force required to retain all of the packages within the five-sided carton when the open side is facing downwards and under conditions of normal handling. On the other hand, too much heat shrinkage may result in wrinkling of the carton material or the tension of the shrunken film may damage the individual cigarette packages. Therefore, films having too high of a heat shrink rating may be undesirable.

Those skilled in the art will also understand that other factors may impact the selection of the proper carton film material, including selecting a film with a desirable coefficient of friction to help retain the packages within the five-sided carton assembly. In a preferred embodiment, the film material has a three-layer structure, with an O.P.P. core and sealable layers of modified acrylic coated O.P.P. materials on the inside and outside surfaces of the film. In some embodiments, the carton film material may be electrostatically charged by means known to those skilled in the art. Such electrostatic charge can help retain the packages of cigarettes within the five-sided carton. Electrostatic charge may be used along with films having greater coefficients of friction or in lieu of films with greater coefficients of friction. To increase the cling property between the carton film material and the package film material, a corona treatment or other treatment known in the art for similar performance may be applied to the confronting surface of the carton film material. Increasing the cling property may facilitate the confinability of the packages within the carton when one or more packages are removed therefrom.

Heat sealable carton film materials may advantageously allow for the elimination or omission of glue and gluing apparatus. Without gluing apparatuses, whatever machinery is repurposed may require less maintenance, as well as less waste, because glue will not have to be used or cleaned from the machinery. Upon stopping the machine, there will be no partially glued cartons that must be discarded. Further, by eliminating the gluing process, the carton filming process avoids the expense of glue and the consumption of resources necessary to manufacture and ship the glue, thereby reducing the carbon footprint for the cartoning process.

The cartons described herein may be made with or without tear tape. In some embodiments, tear tape may be included to help remove the film. However, in other embodiments, no tear tape is included and the user will grasp and pull a package of cigarettes from the five-sided carton. In some instances, it may be desirable for the carton film material to be printable. In such instances, the film may be itself printable or film materials may be selected that include outer layers or coatings that may be printed upon. In addition, a label may be affixed to the carton, such as a UPC bar code, and may cover each of the UPC bar codes of the individual packages. However, when the carton film material is transparent, advertising and health warning labels from the individual packages can be visible through the transparent carton film material, thereby reducing the printing costs to apply such labeling on the outside of the carton film material.

As used herein, the term "package" means a package comparable in size and shape to a conventional cigarette package, which normally contains 20 cigarettes. See, for example, U.S. Pat. No. 4,852,734 to Allen et al., and U.S. Pat. No. 5,139,140 to Burrows et al. The package can be a soft package or, preferably, a crush proof box. Generally, a package has a height of about 70 mm to about 120 mm, and most frequently 20 rod-shaped smoking articles each having a circumference of about 17 mm to about 27 mm are arranged therein in a so called "7-6-7," "7-7-6," or "10-10" configuration.

As used herein, the term "carton" means a carton assembly which is capable of containing 2 rows of 5 cigarette packages, and which most preferably is capable of being passed through commonly employed automated tax stamping apparatus. However, cartons of the kind disclosed herein can hold any number of cigarette packages. Generally, the length of a carton is a minimum of about 266 mm and a maximum of about 286 mm. Generally, the width of a carton ranges from about 26 mm to about 63 mm. Generally, the height of a carton ranges from about 70 mm to about 120 mm. It should, however, be understood that the packages may be oriented in any other manner known to those skilled in the art. For instance, in one embodiment, the packages may be arranged in a single column of ten packages placed front to back. Such alternate geometries may result in differently sized cartons.

In a preferred embodiment, a carton has a length of about 281 mm, height of about 86 mm, width of 48 mm; and contains 10 packages of 20 cigarettes. The packages are arranged in 2×5 fashion within the carton. The carton is manufactured from a plastic film, as explained herein.

The packages within the cartons disclosed herein can be tax stamped using conventional tax stamping apparatus. The exposed ends of the packages can be stamped, without need to open the cartons, rearrange the packages or reseal the cartons. Thus, the manufacturer can provide distributers and jobbers with easily tax stamped cartons, without requiring additional paperboard containers.

It is therefore intended that the foregoing disclosure be regarded as illustrative rather than limiting, and it should be understood that the following claims, including all equivalents, are intended to define the spirit and scope of the invention.

The invention claimed is:

1. A method of forming a carton assembly for a group of packages of smoking articles with a packaging machine comprising:

assembling a plurality of packages of smoking articles into a desired configuration to form a group of packages, the desired configuration being substantially box-shaped having six sides;

supplying a piece of film material of a predetermined size, the film material being heat shrinkable;

folding the film material over the group of packages such that film material covers substantial portions of five sides of the six sides of the group of packages and does not cover one side of the six sides, the uncovered one side exposing a bottom surface of each package of the plurality of the packages of smoking articles, and such that the folded film material on two opposing sides of the group of packages forms an overlapping portion of film material;

heating the overlapping portion of film material for a first period of time to seal together the film material forming the overlapping portion; and heating at least a portion of the film material surrounding the group of packages for a second period of time to heat shrink the film material to a confining fit about the group of packages, whereby the uncovered one side of the six sides is the bottom surface of each package of the plurality of the packages that remains uncovered by the film material.

2. The method of claim 1 wherein subsequent to the folding the film material at least one edge of the film material disposed on one side of the five sides is spaced apart from the uncovered bottom surface to form a gap there along.

3. The method of claim 1 wherein subsequent to the folding the film material, an edge of the film material disposed on four sides of the five sides is spaced apart from the uncovered bottom surface to form a gap there along.

4. The method of claim 1 wherein in the supplying step the film material comprises biaxially oriented polypropylene.

5. The method of claim 1 wherein in the supplying step the film material is transparent.

6. The method of claim 1 wherein in the supplying step the film material includes an outer sealable layer and an inner sealable layer.

7. The method of claim 1 wherein in the heating step to make a confining fit, the portion of the film material that is heated is shrunk by an amount of between 1 and 5 percent in at least one direction.

8. The method of claim 1 wherein in the heating steps the first period of time is less than the second period of time.

9. The method of claim 1 further comprising cooling the overlapping portion after heating the overlapping portion step and prior to heating the film to form a confining fit.

10. The method of claim 1 wherein the film material extends over at least a majority of a portion and less than all of a front side and a back side of the group of packages such that a portion of the front side and the back side of the group of packages are exposed in an area adjacent to the bottom side of the group of packages of smoking articles, said portion of exposed sides being between about 1 and about 20% of an area of the sides.

* * * * *